US008375738B2

(12) United States Patent
Kawasumi et al.

(10) Patent No.: US 8,375,738 B2
(45) Date of Patent: Feb. 19, 2013

(54) SPRINKLE GUIDE OF WATER TRICKLE ICE-MAKING MACHINE

(75) Inventors: Masaaki Kawasumi, Toyoake (JP); Yuji Wakatsuki, Toyoake (JP); Seiji Kobayashi, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 434 days.

(21) Appl. No.: 12/451,554

(22) PCT Filed: Dec. 5, 2007

(86) PCT No.: PCT/JP2007/073508

§ 371 (c)(1), (2), (4) Date: Nov. 18, 2009

(87) PCT Pub. No.: WO2008/142813

PCT Pub. Date: Nov. 27, 2008

(65) Prior Publication Data

US 2010/0115981 A1 May 13, 2010

(30) Foreign Application Priority Data

May 22, 2007 (JP) ..... 2007-135924

(51) Int. Cl.
*F25C 1/00* (2006.01)

(52) U.S. Cl. ..... 62/347; 62/344

(58) Field of Classification Search ..... 62/344, 62/347

See application file for complete search history.

(56) References Cited

U.S. PATENT DOCUMENTS 5,237,837 A * 8/1993 Naruse et al. ..... 62/434
6,349,557 B1 2/2002 Gresham

FOREIGN PATENT DOCUMENTS

JP S59-172975 11/1984
JP S61-63675 4/1986
JP H7-6657 1/1995

* cited by examiner

*Primary Examiner* — Cheryl J Tyler
*Assistant Examiner* — Jonathan Koagel
(74) *Attorney, Agent, or Firm* — DLA Piper LLP (US)

(57) ABSTRACT

A sprinkle guide provided above an ice making plate in a trickle ice making machine having the ice making plate on which vertically extending projecting portions are formed while spaced apart in the lateral direction and making a lump of ice from ice making water supplied to ice making surfaces provided between adjoining projecting portions, and an ice making water tank provided below the ice making plate. The ice making plate includes cover parts located above each projecting portions, guide parts provided between adjoining cover parts to face the ice making surfaces while inclining downward from the projecting end side of the projecting portions toward the ice making surfaces side and guiding the ice making water to the ice making surfaces through a slit defined between the inclination lower end and the ice making surfaces and a notch provided at the upper end of the guide parts.

2 Claims, 9 Drawing Sheets

SPRINKLE GUIDE OF WATER TRICKLE ICE-MAKING MACHINE

TECHNICAL FIELD

The present invention relates to a sprinkle guide of water trickle ice-making machine, which guides ice making water to the ice making surfaces of an ice making plate.

BACKGROUND ART

As an ice making machine which produces ice blocks automatically, a flow-down type ice making machine which can produce a lot of ice blocks at a low cost is known (for example, refer to Patent Document 1). This flow-down type ice making machine is equipped with an ice making unit which produces ice blocks and is located above an ice storage room defined inside an ice storage house.

As shown in FIG. 8 or FIG. 9, an ice making unit 15 has a pair of ice making plates 18, 18 arranged opposite to each other in a substantially vertical posture, and an evaporation tube 24 disposed between the back sides of both ice making plates 18, 18, and as a refrigerant flows through the evaporation tube 24 at the time of carrying out the ice making operation, each ice making plate 18 is forcedly cooled. A plurality of projecting portions 20 which extend in the up-down direction are provided at each ice making plate 18 in a transverse direction for every prescribed interval, and an ice making surface 22*a* which extends on the surface of the ice making plate 18 in the up-down direction is defined by the adjacent projecting portions 20, 20. The ice making unit 15 has an ice making water tank (not shown) which is disposed under the pair of ice making plates 18, 18, and stores ice making water, and has an ice making water sprinkler 32 which is disposed above the pair of ice making plates 18, 18 and sprays water, which is supplied from the ice making water tank, to the ice making surfaces 22*a* of the ice making plate 18. Further, in the ice making unit 15, a sprinkle guide 70 is provided between the ice making water sprinkler 32 and the upper portions of the ice making plates 18 to guide the ice making water sprayed from the ice making water sprinkler 32 to the upper portions of the ice making surfaces 22*a* of each ice making plate 18. In the ice making unit 15, the ice making water is frozen in the process in which ice making water flows down on the ice making surfaces 22*a*, and the unfrozen ice making water flowing down from the lower edge of the ice making surfaces 22*a* is collected into the ice making water tank, and is supplied again to the ice making surfaces 22*a* via the ice making water sprinkler 32 and the sprinkle guide 70.

The sprinkle guide 70 is provided with cover parts 72 located above the projecting portions 20 and guide parts 74 connected to the cover parts 72, provided corresponding to the respective ice making surfaces 22*a* and tilting downward in a direction toward the ice making surfaces 22*a* from the projection ends of the projecting portions 20 in line at the lengthwise sides of the sprinkle guide 70. Here, in the sprinkle guide 70, the upper end of the guide part 74 is formed in level with the upper end of the cover part 72. In the sprinkle guide 70, the inclined lower ends of the guide parts 74 are positioned to be apart by a small clearance from the respective ice making surfaces 22*a*. In the sprinkle guide 70, the ice making water which sprayed from sprinkle holes 32*a* of the ice making water sprinkler 32 is guided by the guide part 74, and is supplied to the ice making surfaces 22*a* via slits 74*a* formed between the inclined lower ends of the guide parts 74, and the ice making surfaces 22*a*.

Patent Document 1: Japanese Utility Model (Registration) Application Laid-open Publication No. H7-6657

DISCLOSURE OF THE INVENTION

Problems to be Solved by the Invention

As mentioned above, in an ice making operation, a flow-down type ice making machine repeats the circulation cycle of cooling ice making water with the ice making plates 18 so as to partially freeze the ice making water, collecting unfrozen ice making water into the ice making water tank, and supplying the collected ice making water to the ice making plates 18 again. Since unfrozen ice making water is also gradually cooled by cooling with the ice making plates 18, ice grains called cotton ice may be produced in ice making water at a time when the supercooling state where the temperature fall to 0° C. or less occurs. When ice making water containing cotton ice is supplied to the sprinkle guide 70, the slits 74*a* are blocked by the cotton ice, so that the ice making water is not sprayed through the slits 74*a*, flows over the upper edge of the sprinkle guide 70 to the outside of the sprinkle guide 70. Especially, the ice making water overflowing from the upper edges of the cover parts 72 of the sprinkle guide 70 flows down along the projecting portions 20 located under the cover parts 72 (see FIG. 9). That is, in the ice making water tank which is mainly assumed to collect unfrozen ice making water flowing down from the ice making surfaces 22*a* of the ice making plates 18, the ice making water which flows down from the projecting portions 20 projecting from the ice making surfaces 22*a* cannot be collected, so that the ice making water leaks out of the ice making water tank. This results in insufficient ice making water in the ice making operation, so that a necessary amount of ice making water cannot be supplied to the ice making plates 18. Therefore, ice blocks M cannot be grown sufficiently, providing irregularly-shaped ice, and deteriorating the marketability of ice blocks M.

When ice making water which is not collected in the ice making water tank drips into the ice storage room and other parts which underlie the ice making unit 15, especially, when it drips into the ice storage room, there arises a problem of causing negative effects, such as melting of the ice blocks M stored in the ice storage room and blocking of the ice blocks M. Further, ice making water, if dropping onto other members, such as electric devices and movable parts, may cause failures of these members or damages thereon. Since the ice making water flowing down along the projecting portions 20, located at both sides of the ice making plates 18, is partly guided to the evaporation tube 24 projecting from the side portions of the ice making plates 18 and other members provided at the side portions of the ice making plates 18, ice making water may freeze in the evaporation tube 24 or the like. At this time, the heat exchange of the evaporation tube 24 with the ice making plates 18 is interfered, bringing about inconveniences of hindering production of ice blocks M on the ice making surfaces 22*a*, or causing damages or the like on the evaporation tube 24.

That is, in view of the problems which are inherent in the sprinkle guide of water trickle ice-making machine according to the related art, this invention has been proposed to solve the problems favorably, and it is an object of the invention to provide a sprinkle guide of water trickle ice-making machine which can make ice blocks of the desired shape and size.

Effect of the Invention

According to the sprinkle guide of the flow-down type ice making machine according to the invention, since ice making water which has overflowed can be collected in the ice making water tank through the notches even if slits are blocked, it is possible to avoid the shortage of ice making water and stably produce ice blocks of the desired shape and size.

BEST MODE FOR CARRYING OUT THE INVENTION

Next, a sprinkle guide of water trickle ice-making machine according to the present invention will be described by way of a preferable embodiment with reference to the accompanying drawings. The top side of an ice making plate is the side which produces ice blocks, and the back side is the side where an evaporation tube which cools the ice making plate is disposed.

Embodiment

Figure 1:
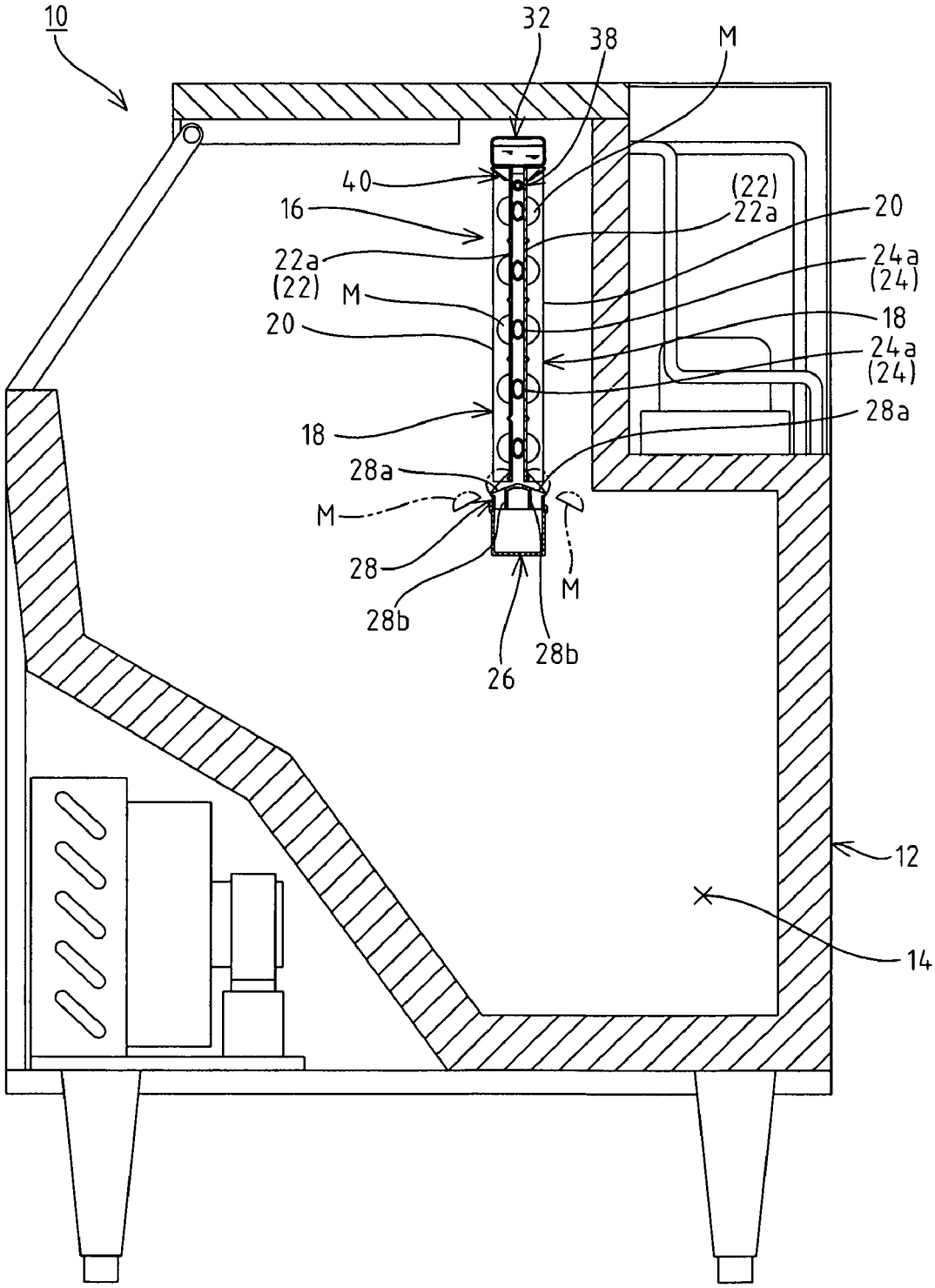
FIG. 1 is a side cross-sectional view showing a flow-down type ice making machine provided with a sprinkle guide according to a preferred embodiment of the invention.
Figure 2:
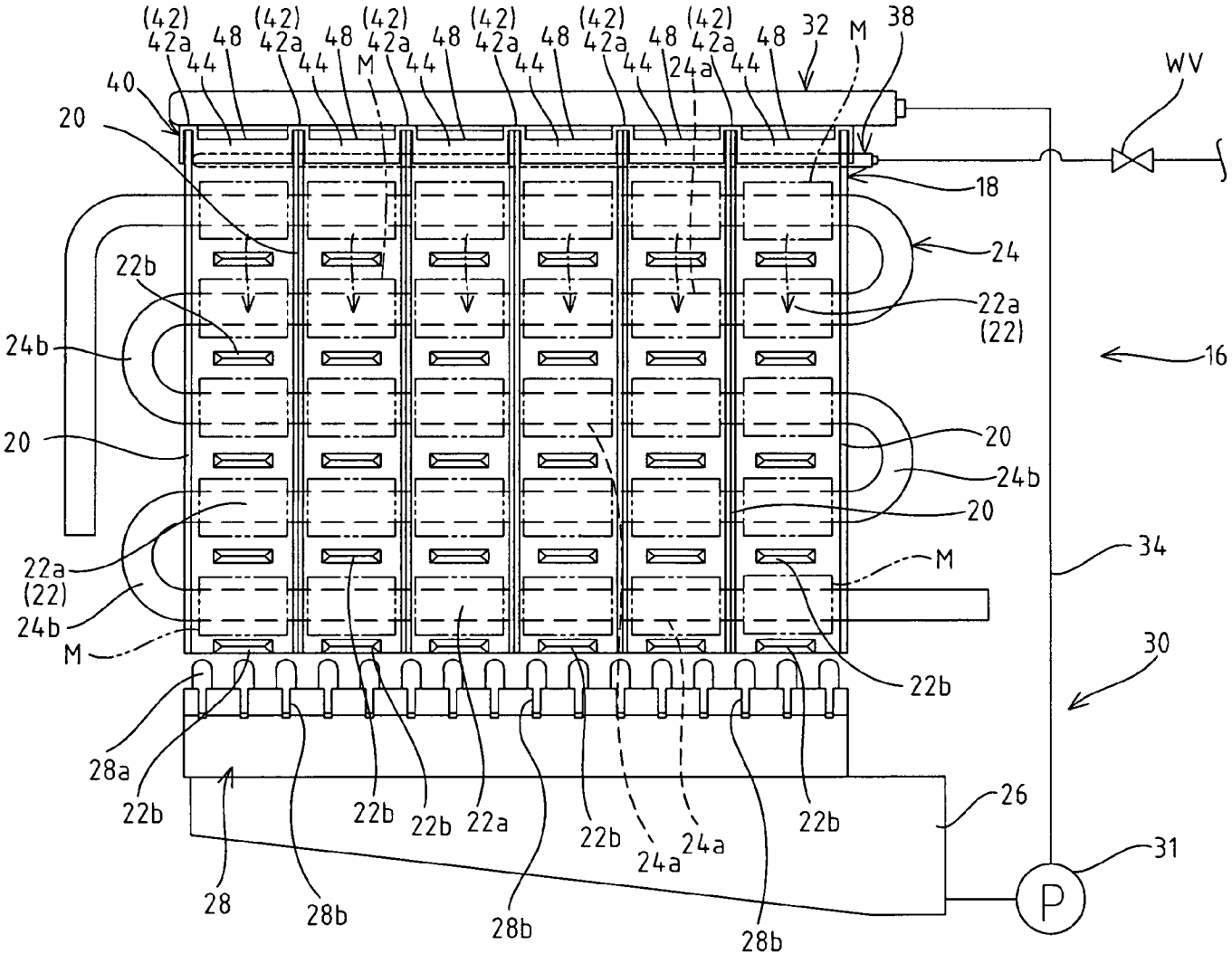
FIG. 2 is a front view of an ice making unit provided with the sprinkle guide according to the embodiment.
Figure 3:
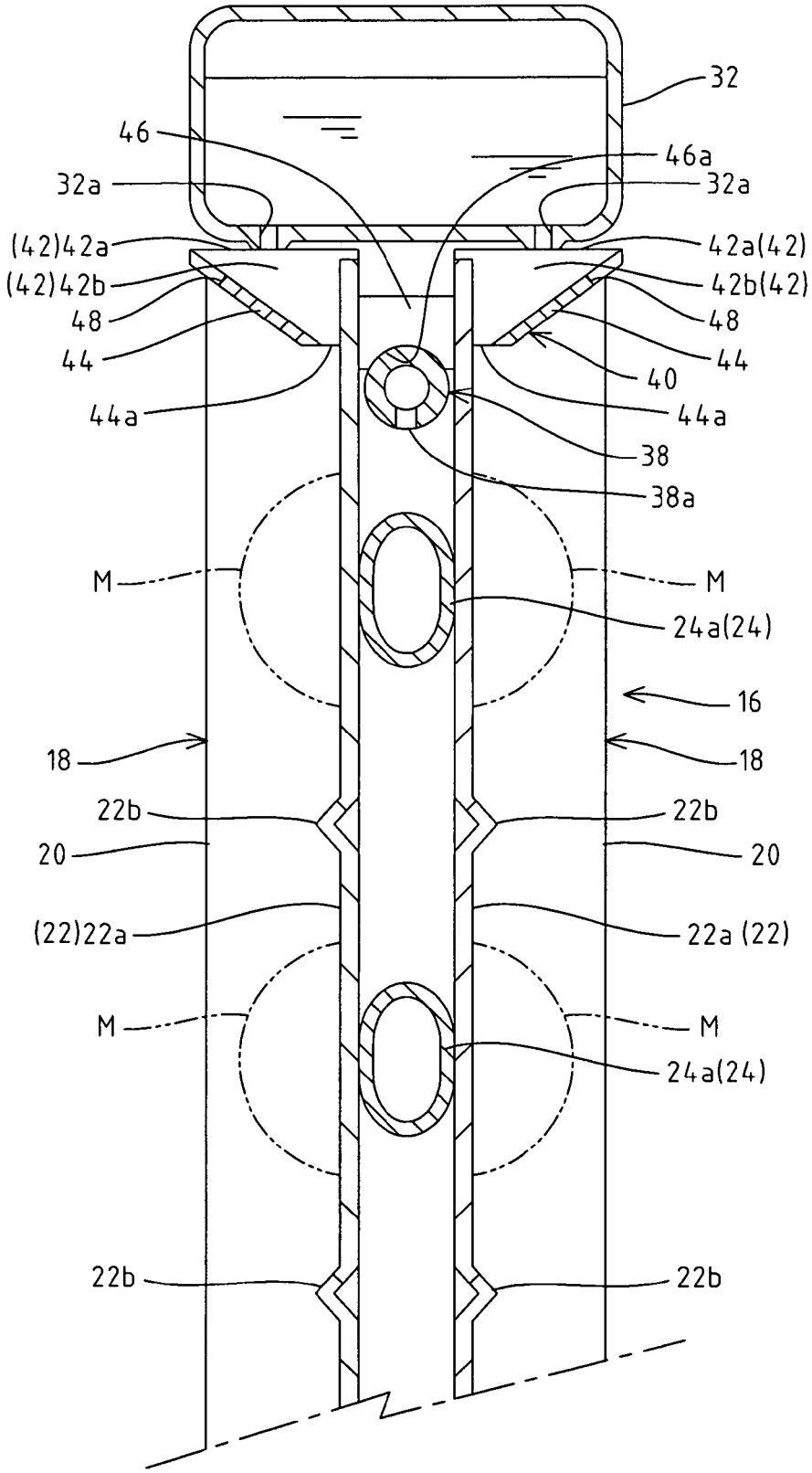
FIG. 3 is a side cross-sectional view showing the ice making unit provided with the sprinkle guide according to the embodiment.

As shown in FIG. 1, in a flow-down type ice making machine 10, an ice making unit 16 which produces ice blocks M is disposed above an ice storage room 14 formed inside a heat insulating box 12, so that ice blocks M discharged from the ice making unit 16 are stored in the ice storage room 14. As shown in FIG. 2 or FIG. 3, the ice making unit 16 has a pair of ice making plates 18, 18 placed opposite to each other with an interval therebetween in a substantially vertical posture, an evaporation tube 24 disposed between the opposing sides of both ice making plates 18, 18, and an ice making water tank 26 which is provided directly under both ice making plates 18, 18 to store the ice making water and collect the ice making water, flowing down from both ice making plates 18, 18. The ice making unit 16 is provided with the ice making water feeding means 30 which supplies ice making water to the top sides of both ice making plates 18, 18 from the ice making water tank 26, and deicing water feeding means 38 which is connected to an external water supply source, such as a waterworks, and supplies deicing water to the back sides of both ice making plates 18, 18 at the time of carrying out the deicing operation.

The ice making plate 18 has a plurality of projecting portions 20 provided apart from one another at intervals in the transverse direction of this ice making plate 18, and extending in the up-down direction, and ice making parts 22 defined between the adjacent projecting portions 20, 20. That is, the ice making plate 18 is formed in the zigzag pattern with the angular projecting portions 20 and the flat ice making parts 22 being continuous as seen in a plan view. Each projecting portion 20 is formed so that it projects toward the side away from the other ice making plate 18, and the surface side of the ice making plate 18 is projective. The projecting portions 20 are arranged at both side portions of the ice making plates 18, respectively. The pair of ice making plates 18, 18 have the same structure, and are disposed in a symmetric relation with the evaporation tube 24 in between.

The ice making parts 22 are configured such that the surface side of the ice making plate 18 serves as the ice making surface 22*a* where the ice blocks M are produced, and a plurality of ice blocks M are produced apart from one another in the up-down direction on the ice making surfaces 22*a* extending in the up-down direction. Projections 22*b* which allow the ice blocks M to be separated from the ice making surfaces 22*a* are formed on the ice making parts 22 below the respective corresponding ice making positions of the ice making surfaces 22*a* where the ice blocks M are produced. Each projection 22*b* is formed in such a way that the bottom which faces the ice making surface 22*a* has an laterally elongated rectangular shape in the transverse direction, and the cross section has a triangular with the top and bottom sides serving as oblique sides as shown in FIG. 3.

The evaporation tube 24 is formed in the repetitive meandering state, and is provided between the opposing faces of both ice making plates 18, 18 with straight portions 24*a* extending in the transverse direction and bent portions 24*b* positioned at side portions of the ice making plates 18 as shown in FIG. 2. The straight portions 24*a* of the evaporation tube 24, which extend, apart from one another in the up-down direction of the ice making plates 18, contact the back sides of the ice making parts 22 of each ice making plate 18, and the ice making surfaces 22*a* of the ice making parts 22 corresponding to the contact portions of the straight portions 24*a* become ice making positions where the ice blocks M are produced. The evaporation tube 24 constitutes a part of a freezer which is not illustrated, and exchanges heat with the refrigerant flowing through the evaporation tube 24 to forcedly cool the ice making parts 22 of each ice making plate 18 at the time of carrying out the ice making operation.

The ice making water tank 26 is formed in a box shape with the top portion open. The ice making water tank 26 has a lateral size set substantially identical to the lateral size of the ice making plate 18 and a front-back size set substantially identical to the size from the projecting end of the projecting portion 20 of one ice making plate 18 to the projecting end of the projecting portion 20 of the other ice making plate 18. The upper opening of the ice making water tank 26 is arranged directly under the ice making parts 22 and the projecting portions 20 of both ice making plates 18, 18 to receive unfrozen ice making water from both ice making plates 18, 18, and the deicing water supplied from the deicing water feeding means 38, and store the waters as ice making water to be used in the ice making operation. An ice guide member 28 which guides the ice blocks M separated from both ice making plates 18, 18 at the time of carrying out the deicing operation is mounted at the upper end portion of the ice making water tank 26. The cross section of the ice guide member 28 which is opposite to both ice making plates 18, 18 is formed in an angular shape (see FIG. 1), and the crest of this angular shape is arranged so as to face the mid-position between the back sides of both ice making plates 18, 18, so that the ice blocks M are guided by inclined surfaces 28*a* positioned under the respective ice making plates 18, 18. A plurality of through holes 28*b* are formed in each inclined surface 28*a* of the ice guide member 28, so that unfrozen ice making water and deicing water are separated from the ice blocks M by the ice guide member 28, and only ice making water and the like are collected into the ice making water tank 26.

The ice making water feeding means 30 has an ice making water sprinkler 32 provided above the pair of ice making plates 18, 18 which feeds ice making water to each ice making plate 18, an ice making water pump 31 which pumps out ice making water from the ice making water tank 26 to the ice making water sprinkler 32 via an ice making water pipe 34, and a sprinkle guide 40 formed between the ice making water sprinkler 32 and the pair of ice making plates 18, 18 (see FIG. 2). The ice making water sprinkler 32 is a long cylindrical hollow member extending in the whole transverse direction of the ice making plates 18, has one side connected with the ice making water pipe 34 and a plurality of sprinkle holes 32*a* formed in the bottom side. The ice making water sprinkler 32 sprinkles the ice making water pumped out from the ice making water tank 26 from the individual sprinkle holes 32*a* at the time of carrying out the ice making operation.

Figure 4:
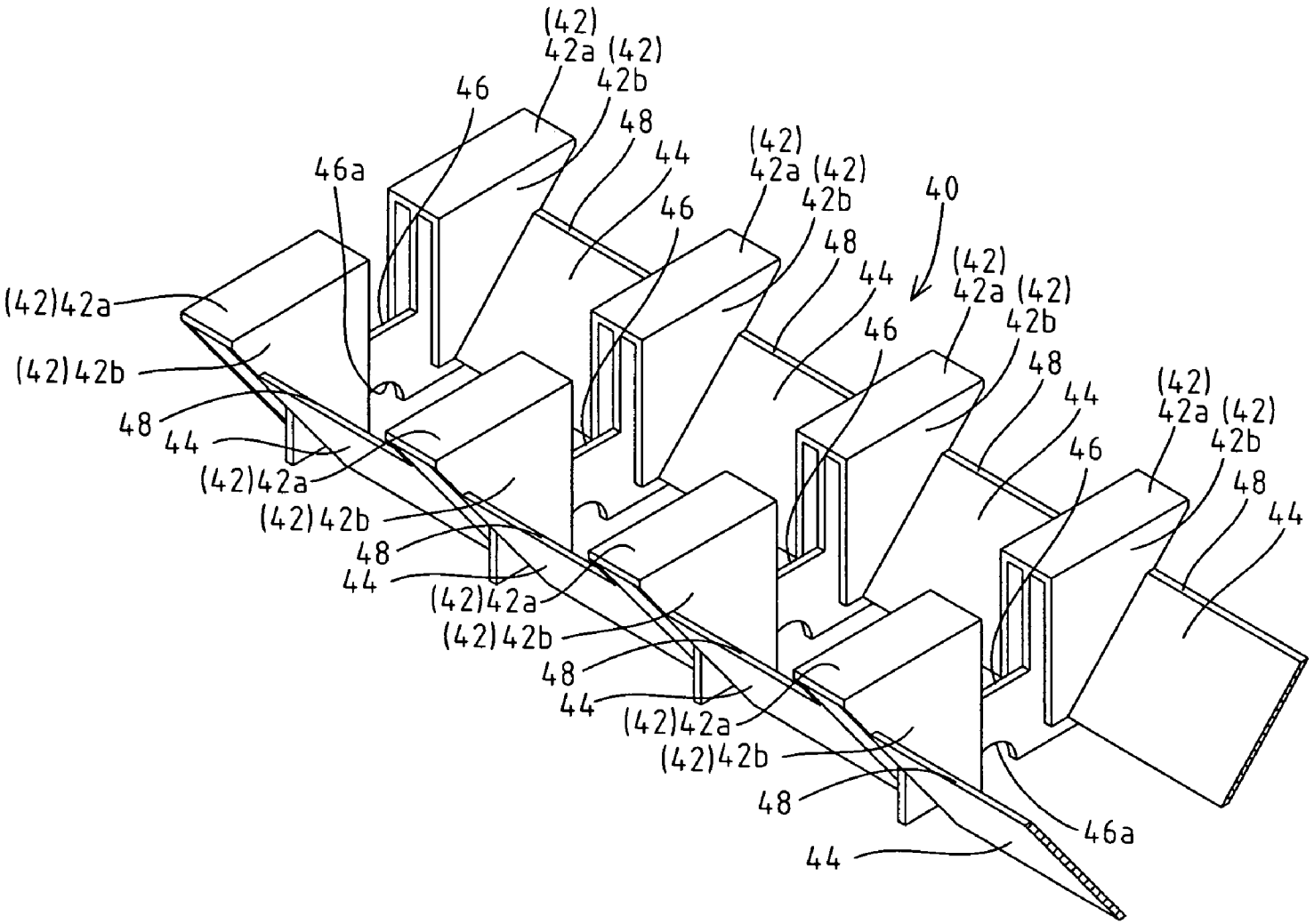
FIG. 4 is a perspective view partially showing the sprinkle guide according to the embodiment.
Figure 5:
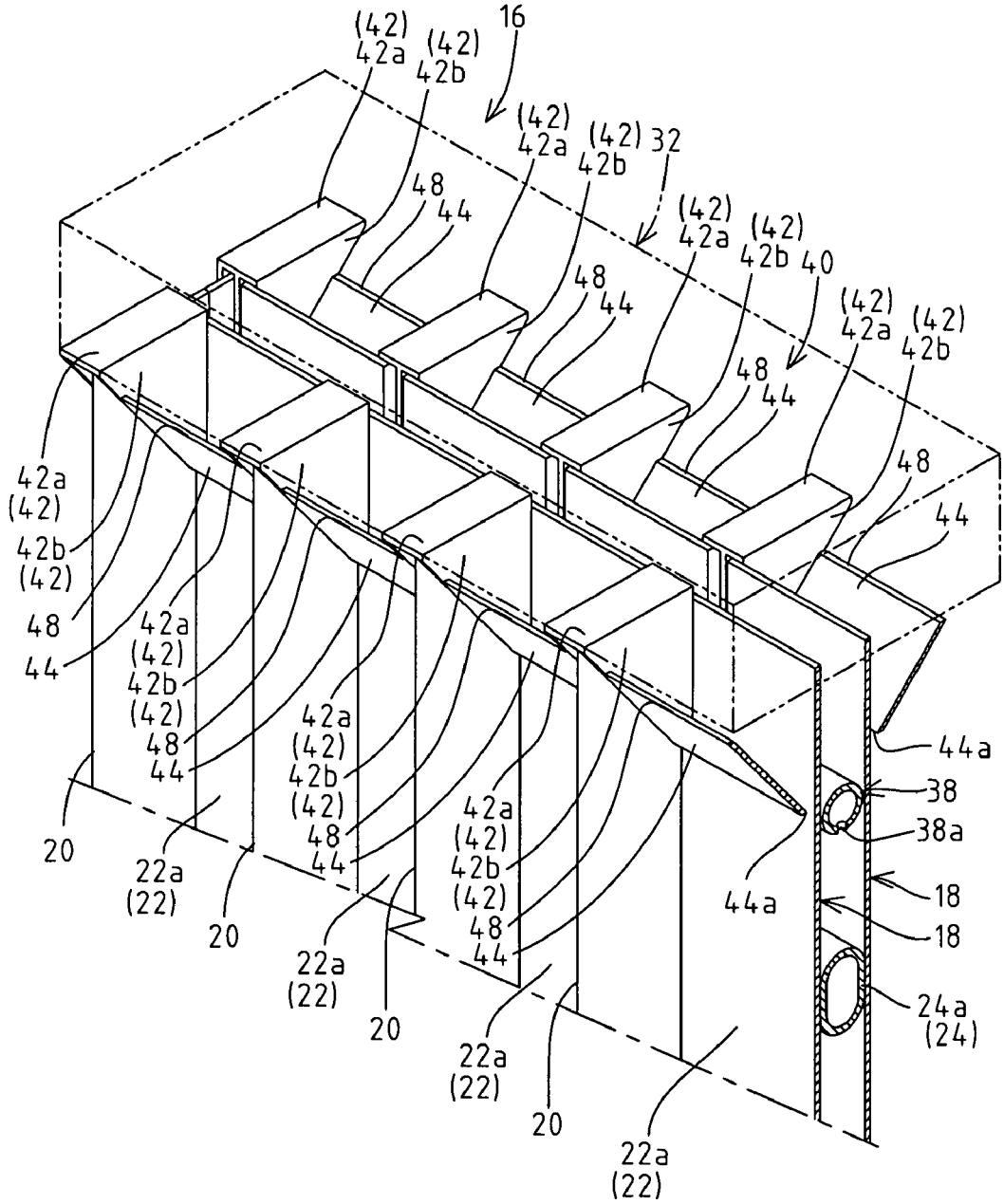
FIG. 5 is a perspective view showing the essential portions of the ice making unit having the sprinkle guide according to the embodiment mounted thereto.

As shown in FIG. 4 or FIG. 5, the sprinkle guide 40 is a long member formed so as to extend in the whole transverse direction of the ice making plates 18, and is attached to the upper portions of the pair of ice making plates 18, 18 while facing the bottom side of the ice making water sprinkler 32. Guidance lines each having a cover part 42 located at the upper portion of each projecting portion 20 of each ice making plate 18 and a guide part 44 located corresponding to each ice making part 22 of each ice making plate 18 are formed at the sprinkle guide 40 in a symmetric relation with respect to the ice making plates 18 along the long sides thereof.

Each cover part 42 comprises a horizontal piece 42*a* extending horizontally, and side pieces 42*b* hanging downward respectively from both side edges of the horizontal piece 42*a*. When the sprinkle guide 40 is attached to the ice making plates 18, the horizontal piece 42*a* of each cover part 42 covers the upper portion of the projecting portion 20, and the side pieces 42*b* cover the upper portions of the corresponding side surfaces of the projecting portion 20 on the surface side. In the sprinkle guide 40, the opposing guidance lines are connected by a link part 46 provided across between the opposing cover parts 42, 42 which (see FIG. 4).

Each guide part 44 is provided to be connected to the opposing side pieces 42*b*, 42*b* of the cover parts 42, 42 adjoining in the transverse direction, and is formed to be inclined downward from above in one direction (direction of approaching the other guidance line in the embodiment). That is, each guide part 44 is formed so as to be inclined downward toward the ice making surface 22*a* of the ice making part 22 from the projecting end side of the projecting portion 20 when the sprinkle guide 40 is attached to the ice making plate 18 (see FIG. 5). A slit 44*a* which permits the down flow of ice making water is formed between the inclined lower end of each guide part 44 and the ice making surface 22*a* (see FIG. 3). The horizontal width of each guide parts 44 is set substantially equal to the horizontal width of the ice making surface 22*a* of the corresponding ice making part 22. Each guide part 44 is made to receive ice making water sprayed through the sprinkle hole 32*a* of the ice making water sprinkler 32 which is provided corresponding to the guide part 44, and guide the ice making water to the ice making surfaces 22*a* of the corresponding ice making parts 22 via slits 44*a*.

A notch 48 set lower than the upper end of the cover part 42 is formed in the upper end of each guide part 44. That is, the upper end edge of each guide part 44 which is provided at a position lower than the horizontal piece 42*a* of the laterally adjoining cover part 42 serves as the notch 48. In the embodiment, the upper end edge is provided at the whole upper end of the guide part 44 at a position lower than the horizontal piece 42*a* of the cover part 42, and the notch 48 is formed across the whole upper end (between the laterally adjoining cover parts 42, 42). In the sprinkle guide 40, when the slits 44*a* are blocked with cotton ice, ice making water overflows only from the notch 48. The notch 48 is located closer to the ice making surfaces 22*a* than the projecting end of the projecting portion 20, and the upper opening of the ice making water tank 26 faces directly under the notch 48. In an embodiment, the notch 48 is set to be lower than the upper ends of the cover parts 42 by 1 mm to 10 mm or so. Here, as for the sprinkle guide 40, a molded article of a synthetic resin which has the cover part 42, the guide part 44 and the link part 46 formed integrally.

The deicing water feeding means 38 is attached to the upper portion between the back sides of both ice making plates 18, 18 and below the link part 46 of the sprinkle guide 40. The deicing water feeding means 38 is a tubular body provided with feed holes 38*a* open downward, and is connected with a deicing water pipe which is connected to an external water source via a water feed valve WV at one side. At the time of carrying out the deicing operation, the deicing water feeding means 38 sprinkles deicing water to the back sides of both of the ice making plates 18, 18 through the feed holes 38*a* with the water feed valve WV opened. A groove 46*a* formed according to the outer shape of the deicing water feeding means 38 is provided in the link part 46 of the sprinkle guide 40, and the deicing water feeding means 38 is positioned by the groove 46*a*.

Operation of Embodiment

Next, the operation of the sprinkle guide 40 according to the embodiment will be described. In the ice making operation, as the ice making water pump 31 is driven, the ice making water stored in the ice making water tank 26 is supplied to the ice making water sprinkler 32 via the ice making water pipe 34. The ice making water is guided from the sprinkle hole 32*a* of the ice making water sprinkler 32 to the guide parts 44 of the sprinkle guide 40 facing the sprinkle holes 32*a*, and is guided by the inclination of the guide parts 44 to flow down to be supplied to the corresponding ice making surfaces 22*a* of the ice making plates 18 through the slits 44*a* formed at the inclined lower ends of the guide parts 44. The ice making water flows down on the ice making surfaces 22*a* of the ice making plate 18 in the form of a film, and starts to be gradually frozen around the ice making position cooled by heat exchange with the refrigerant which flows in the evaporation tube 24. The ice making water which flows down unfrozen from both ice making plates 18, 18 is collected in the ice making water tank 26 via the through holes 28*b* of the ice guide member 28, and is supplied again to both ice making plates 18, 18.

At a time when a supercooling state where the unfrozen ice making water is gradually cooled by cooling with the ice making plates 18 and its temperature drops to 0° C. or less occurs, cotton ice may be produced. Since the slits 44*a* formed in the ice making surfaces 22*a* of the ice making plates 18 and the inclined lower ends of the guide parts 44 are set at narrow intervals, if the quantity of the cotton ice contained in the ice water increases, the cotton ice is caught in the slits 44*a* to be deposited there gradually, interfering with the circulation of the ice making water. If the quantity of the ice making water which is sprayed onto the guide parts 44 from the ice making water sprinkler 32 becomes larger than the quantity of the ice making water which flows down through the slits 44*a*, the ice making water stays between the ice making surfaces 22*a* of the ice making plates 18 and the guide parts 44. The deposited ice making water flows over the notches 48 formed in the upper ends of the guide parts 44, and flows outside the sprinkle guide 40.

Because the notches 48 of the sprinkle guide 40 are set lower than the upper ends of the cover parts 42, the ice making water can be made to overflow only from the notches 48 without overflowing from the cover parts 42. The ice making water which has overflowed from the notes 48 flows down toward the ice making surfaces 22*a* along the outer surfaces of the guide parts 44, partially flows down to the ice making surfaces 22*a* of the ice making plates 18 while the other part flows down from the inclined lower ends of the guide parts 44. Since the ice making water tank 26 is arranged below the ice making surfaces 22*a* of each ice making plate 18, and below the inclined lower ends of the guide parts 44, the ice making water overflowed from the notches 48 is collected in the ice making water tank 26. What is more, since the notches 48 are provided at the whole upper ends of the guide parts 44, even if there is a large quantity of overflowing ice making water, the ice making water can be smoothly guided toward the ice making surfaces 22*a* of the ice making plates 18.

As the notches 48 are formed at the upper ends of the guide parts 44, and are set lower than the upper ends of the cover parts 42, it is possible to avoid overflowing of ice making water from the cover parts 42, even if the slits 44*a* are blocked with cotton ice. The guide parts 44 are formed corresponding to the ice making surfaces 22*a* of the ice making parts 22 of the ice making plates 18, so that even if the notches 48 are provided at the whole upper ends of the guide parts 44, the overflowed ice making water is guided mainly toward the ice making surfaces 22*a*, thus making it possible to minimize the ice making water which flows down along the projecting portions 20.

Since most of the unfrozen ice making water can be collected into the ice making water tank 26 even if the slits 44*a* are blocked with cotton ice, and thus ice making water overflows from the sprinkle guide 40, the shortage of ice making water can be avoided in the ice making operation. In the ice making operation, therefore, irrespective of whether cotton ice is produced or not, ice blocks M of the desired shape and desired size can be produced stably. The ice making water overflowed from the notches 48 is guided toward the ice making plates 18 along the outer surfaces of the guide parts 44, thus minimizing the ice making water which flows down through the projecting portions 20, so that the outflow of the ice making water to the outside can be suppressed even if the ice making water tank 26 is not set large. Further, the ice making water which flows along the projecting portions 20 is minimized, thus making it possible to suppress freezing of the ice making water in the evaporation tube 24, so that it is less likely that reduction in ice made on the ice making plates 18 and damages or the like on the evaporation tube 24, occur.

Further, since it is possible to suppress the ice making water which flows outside without being collected in the ice making water tank 26, it is possible to suppress dropping of ice making water onto the ice blocks M stored in the ice storage room 14 positioned below the ice making unit 16 or another member, such as an electrical part or a movable part. That is, it is less likely that the ice making water causes the ice blocks M in the ice storage room 14 to melt, or causes ice blocks to join together to block, making it possible to avoid spoiling the marketability of the ice blocks M. Since failures and damages on other members where adhesion of ice making water thereto, or freezing of ice making water is not expected, can be suppressed, so that the life of these members can be made longer.

Cotton ice should not necessarily occur in every ice making operation, cotton ice, if produced, is melted and removed as each ice making plate 18 is heated up in the deicing operation.

Modifications

The present invention is not limited to the configuration of the above-described embodiment, and may also be modified as follows.

Figure 6:
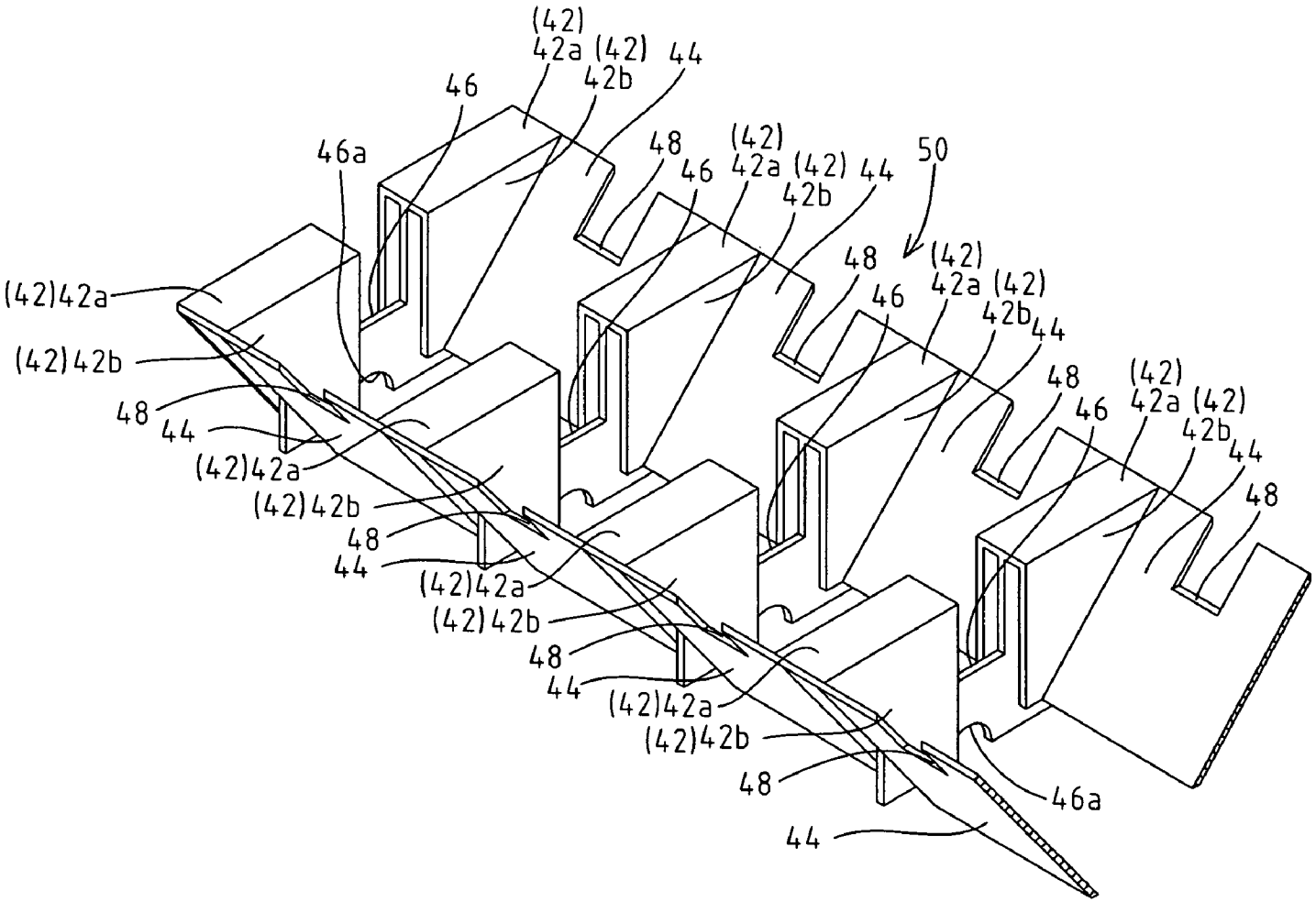
FIG. 6 is a perspective view showing a sprinkle guide according to a modification.
Figure 7:
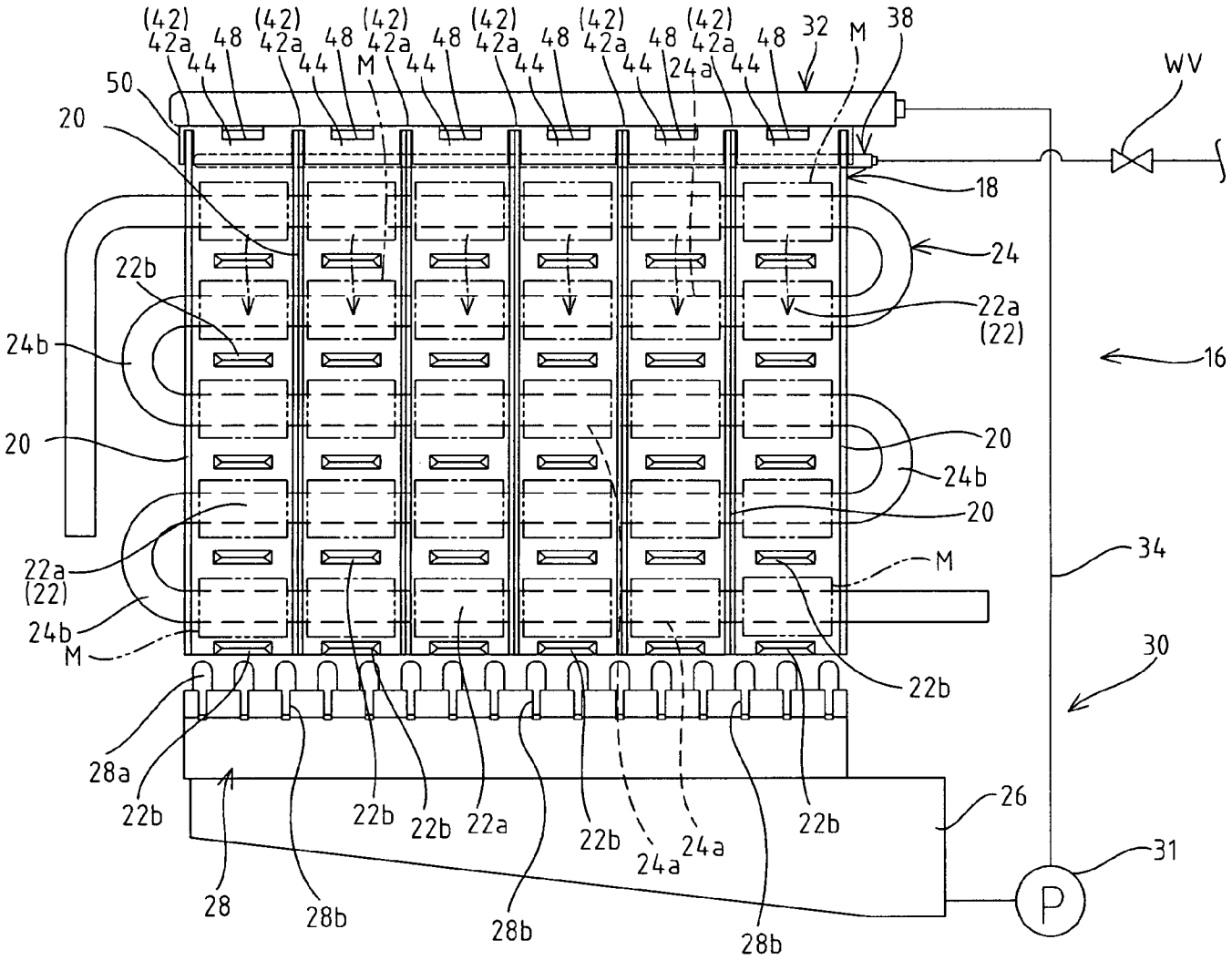
FIG. 7 is a front view of an ice making unit provided with the sprinkle guide according to the modification.
Figure 8:
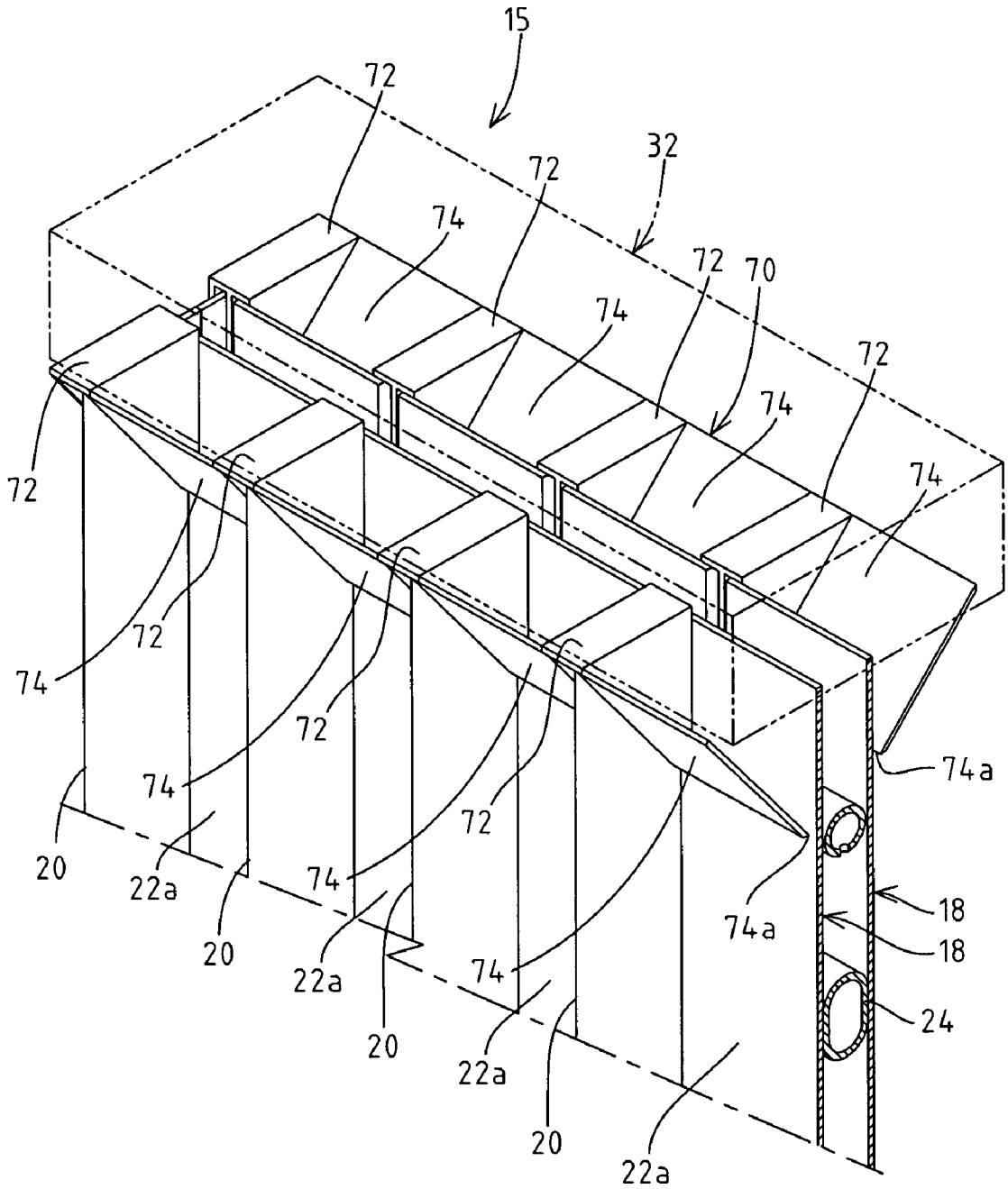
FIG. 8 is a perspective view showing the essential portions of the ice making unit provided with a conventional sprinkle guide.
Figure 9:
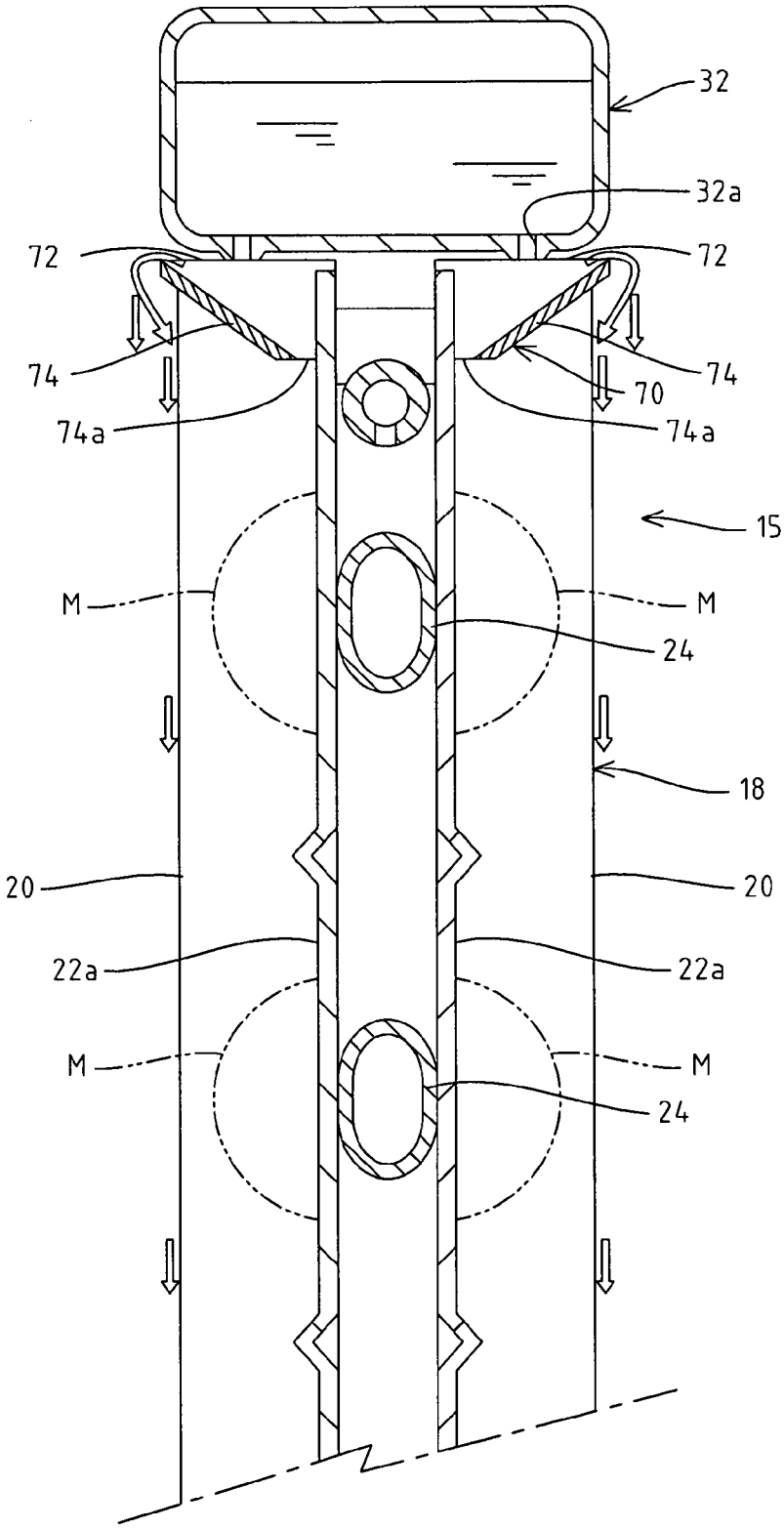
FIG. 9 is a side cross-sectional view showing the ice making unit provided with the conventional sprinkle guide.

(1) Although the notches are formed at the whole upper ends of the guide parts 44 in the embodiment, the notches 48 may be formed in the centers of the upper ends of the guide parts 44, apart from the cover parts 42 at widths narrower than the whole upper ends of the guide parts 44, as in the sprinkle guide 50 according to the embodiment shown in FIGS. 6 and 7. The notches 48 of the modification is set about ½ of the width of the whole upper ends of the guide parts 44. According to the sprinkle guide 50 of the modification, the notches 48 are provided in the centers of the upper ends of the guide parts 44, when the slits 44*a* are blocked with cotton ice, the ice making water overflowed from the notches 48 flows down along the center of the outer surfaces of the guide parts 44, and the center of the ice making surfaces of the ice making plates 18, it is possible to more surely prevent the ice making water from flowing along the projecting portions 20. In FIGS. 6 and 7, the same reference numerals are given to those members and configurations which are similar to the configurations of the embodiment to omit their descriptions.

(2) Although the description of the embodiment has been given of the configuration where a pair of ice making plates are disposed opposite to each other as ice making parts with the evaporation tube in between, the evaporation tube may be arranged in a meandering manner on the back side of, for example, a single evaporation tube.

(3) Although the modification (1) has been described by way of an example where one notch is provided at the upper end of the guide part, it is possible to employ a structure that a plurality of notches are provided at the upper end of the guide part. The notches may be provided at positions shifted to the cover part side, not at the centers of the upper ends of the guide parts, as long as the notches are provided at the upper ends of the guide parts apart from the cover parts.

(4) The notch may change the position from the upper end of the cover part and the width at the upper end of the guide part for each part.

The invention claimed is:

1. A sprinkle guide of water trickle ice-making machine which has an ice making plate (18) with projecting portions (20) extending in an up-down direction, formed in a lateral direction at an interval, and produces ice blocks (M) from ice making water supplied to ice making surfaces (22*a*) provided between adjoining projecting portions (20, 20), and an ice making water tank (26) provided under the ice making plate (18) to collect ice making water flowing down from the ice making surfaces (22*a*) of the ice making plate (18), the sprinkle guide being provided above the ice making plate (18) to guide the ice making water supplied from the ice making water tank (26) to the ice making surfaces (22*a*) of the ice making plate (18), comprising:

cover parts (42) positioned above the respective projecting portions (20);

guide parts (44) provided between adjoining cover parts (42, 42) in a posture inclined downward toward the ice making surfaces (22*a*) from projection ends of the projecting portions (20) in such a way as to face the ice making surfaces (22*a*), the guide parts (44) guiding the ice making water to the ice making surfaces (22*a*) via slits (44*a*) formed between inclined lower ends and the ice making surfaces (22*a*); and notches (48) provided at upper ends of the guide parts (44) so that each of the notches (48) is set to be located lower than each upper end of the cover parts (42), wherein the notches (48) are formed at the whole upper end of the guide parts (44).

2. A sprinkle guide of water trickle ice-making machine which has an ice making plate (18) with projecting portions (20) extending in an up-down direction, formed in a lateral direction at an interval, and produces ice blocks (M) from ice making water supplied to ice making surfaces (22*a*) provided between adjoining projecting portions (20, 20), and an ice making water tank (26) provided under the ice making plate (18) to collect ice making water flowing down from the ice making surfaces (22*a*) of the ice making plate (18), the sprinkle guide being provided above the ice making plate (18) to guide the ice making water supplied from the ice making water tank (26) to the ice making surfaces (22*a*) of the ice making plate (18), comprising:

cover parts (42) positioned above the respective projecting portions (20);

guide parts (44) provided between adjoining cover parts (42, 42) in a posture inclined downward toward the ice making surfaces (22*a*) from projection ends of the projecting portions (20) in such a way as to face the ice making surfaces (22*a*), the guide parts (44) guiding the ice making water to the ice making surfaces (22*a*) via slits (44*a*) formed between inclined lower ends and the ice making surfaces (22*a*); and notches (48) provided at upper ends of the guide parts (44) so that each of the notches (48) is set to be located lower than each upper end of the cover parts (42), wherein the notches (48) are formed at the upper end of the guide parts (44) apart from the cover parts (42) at a width narrower than the whole upper end of the guide parts (44).

* * * * *